US005715577A

United States Patent [19]

Lautenschläger et al.

[11] Patent Number: 5,715,577

[45] Date of Patent: Feb. 10, 1998

[54] DOOR-RELATED MEMBER OF A FURNITURE HINGE

[75] Inventors: Horst Lautenschläger, Reinheim; Gerhard Wilhelm Lautenschläger, Brensbach-Wersau, both of Germany

[73] Assignee: MEPLA-Werke Lautenschläger GmbH & Co. KG, Germany

[21] Appl. No.: 631,640

[22] Filed: Apr. 8, 1996

[30] Foreign Application Priority Data

May 10, 1995 [DE] Germany ..... 195 17 021.0
Jun. 16, 1995 [DE] Germany ..... 195 21 909.0

[51] Int. Cl.[6] ..... E05D 5/02
[52] U.S. Cl. ..... 16/383
[58] Field of Search ..... 16/383

[56] References Cited

U.S. PATENT DOCUMENTS 4,361,931 12/1982 Schnelle et al. ..... 16/383
5,463,796 11/1995 Brustle et al. ..... 16/383
5,577,297 11/1996 Lautenschlager et al. ..... 16/383

FOREIGN PATENT DOCUMENTS 0610765 8/1994 European Pat. Off. .
4336326 4/1995 Germany ..... 16/383
4427293 4/1995 Germany ..... 16/383

*Primary Examiner*—Chuck Mah
*Assistant Examiner*—Donald M. Gurley

[57] ABSTRACT

Door-related hinge member (26) having a cup part with flattened sides, which is to be driven into a mortise in the back of a door. A flange extending outward against the back of the door is integral with the rim of the cup part, and retaining members are provided at the flattened sides, which can be spread apart by means of a handle provided on the flange in order to drive them into the wall of the mortise. On the bottom of the flange one or more centering pins can be provided for engagement in holes adjacent the mortise. Each retaining member (52) reaches substantially across the height of the associated flat in the cup part and through an opening in the mounting flange, and can swing radially on the cup part. On the emergent upper end of each retaining member a lever arm is provided which extends outwardly over the mounting flange, and at its outer free end it engages the associated handles by means of which the lever arm can be turned from a position lying substantially on the flange to a second position raised away from the flange.

21 Claims, 7 Drawing Sheets

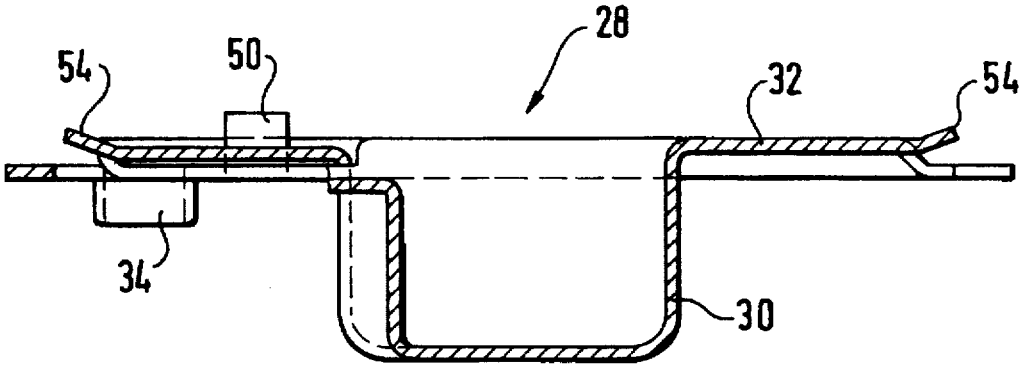
FIG. 3
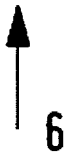
FIG. 4
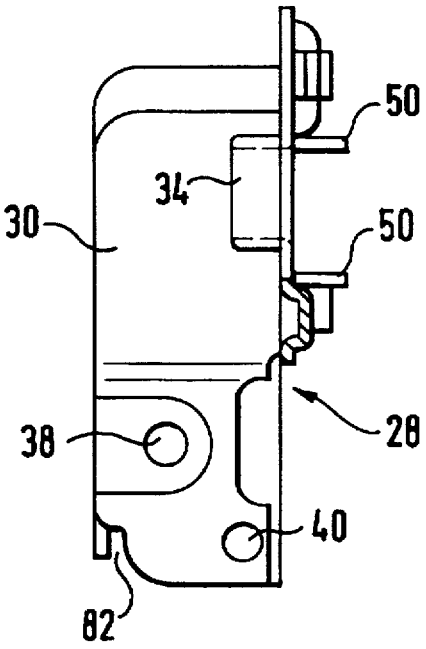
FIG. 5
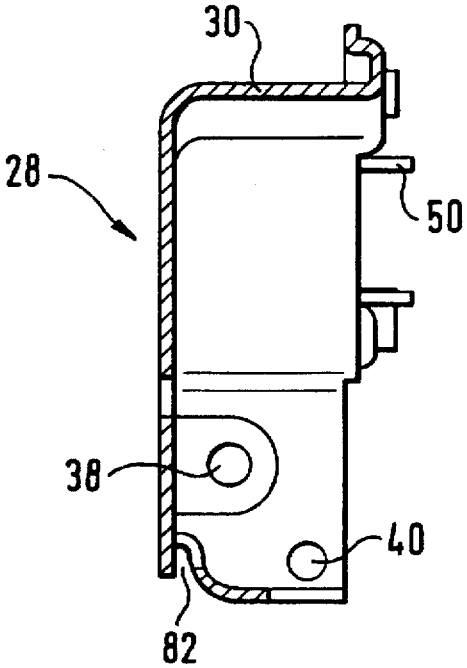

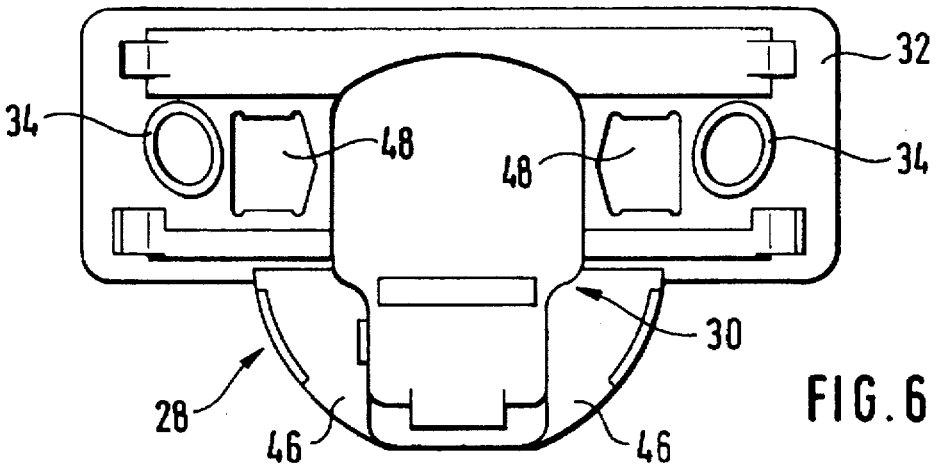
FIG. 6
FIG. 7
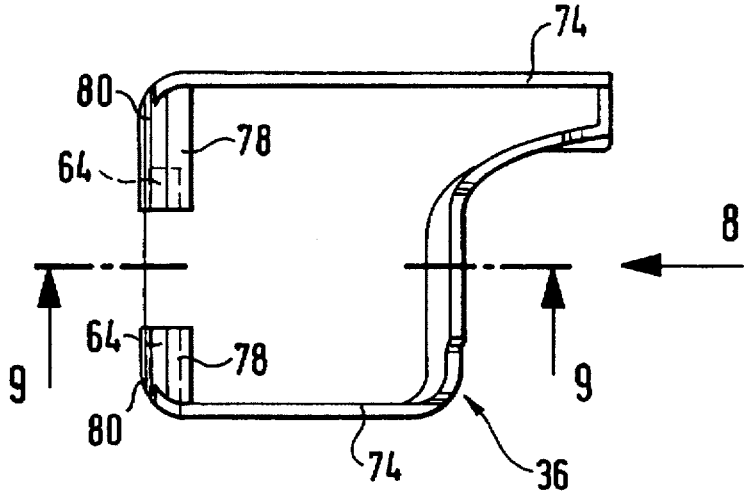
FIG. 8
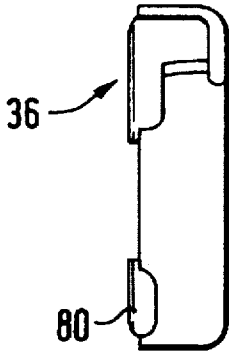
FIG. 9
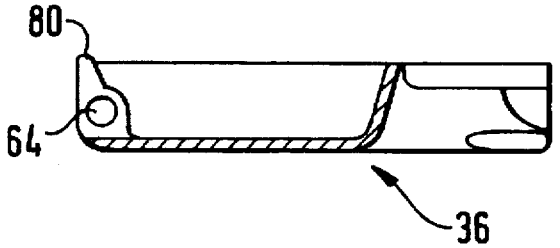

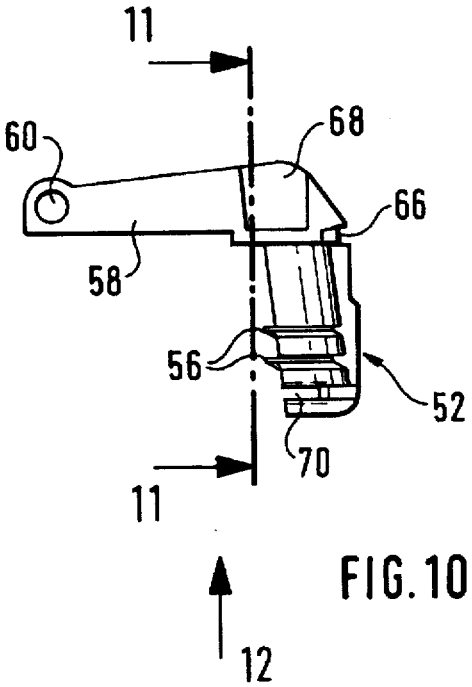
FIG. 10
FIG. 11
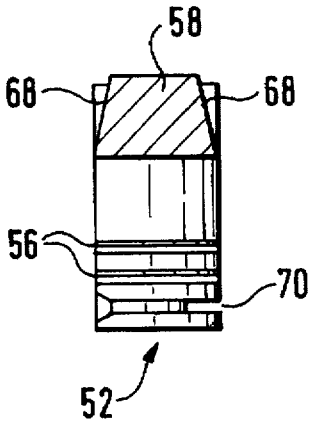
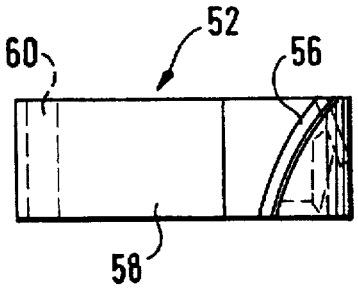
FIG. 12
FIG. 13
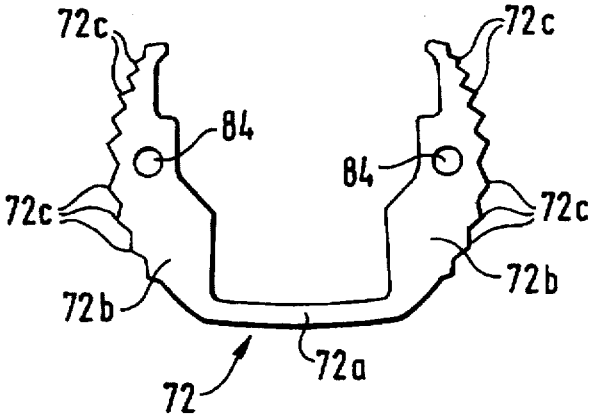

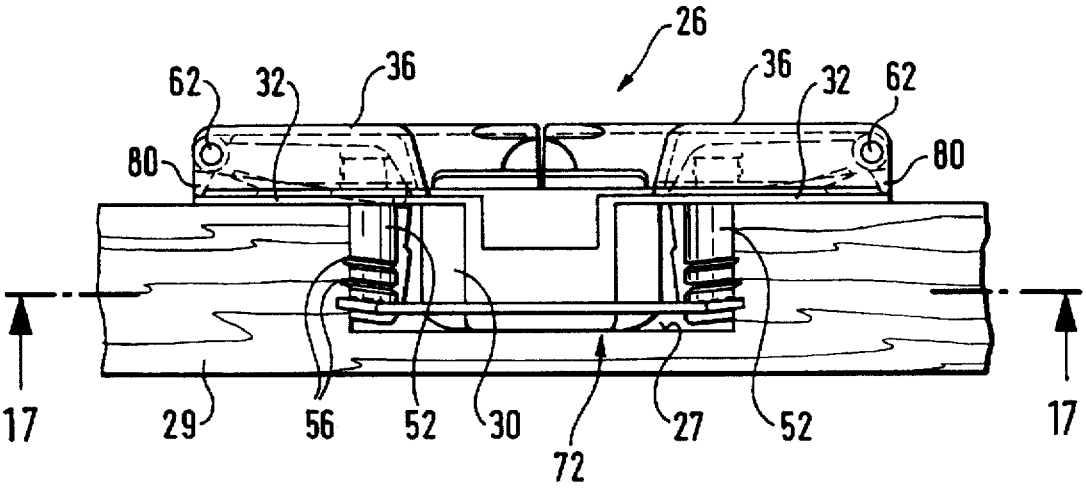
FIG. 16
FIG. 17
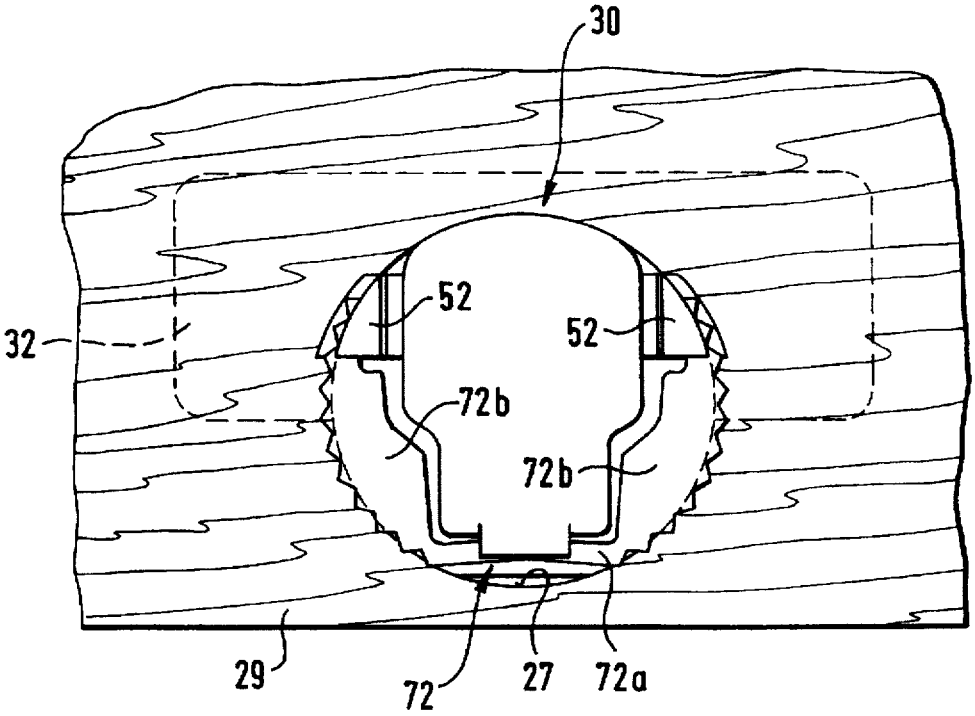

DOOR-RELATED MEMBER OF A FURNITURE HINGE

The invention relates to the door-related member of a furniture hinge, which has a cup having flats on both sides, which is to be inserted in a substantially circular mortise in the back of the door; a mounting flange is integral with the upper rim of the cup and lies against the back of the door, and it has retaining means in the area of its lateral flats, which by means of at least one handle provided on the flange can be urged against the wall of the mortise. On the bottom of the flange at least one centering pin projecting substantially at right angles can be provided for engagement in a bore adjacent the mortise.

A hinge of this kind is known (EP 0 610 765 A1), which can be installed in the mortise in the back of the door without tools because jaws in the shape of a segment of a cylinder of tough elastic material are provided on the side flats of the cup. Wedge-like means can be drawn between the cup and the jaws by a handle provided on a shaft disposed on the flange and running parallel to the hinge pin such that the jaws are forced radially outward into clamping engagement with the wall of the mortise. This drawing in of the wedges is performed through cam means provided on the handle when the handle is turned from an installation or removal position raised 90° to a fastening position lying against the mounting flange. That is, the actual fastening of this known hinge cup is performed by clamping the cup in its mortise, while pins projecting from the bottom of the flange into separate holes of the back of the door only assure the correct rotational position of the cup in the mortise during installation—i.e., they are not fastening pins. The known hinge can be installed and removed again without any special tool. The known cup hinge member is not only relatively complex in design and thus expensive to make, but due to the friction between the wedge and the jaws it calls for the application of relatively great force to install, so that the advantage of installation without a separate tool is partially negated.

The invention, on the other hand, is addressed to the problem of creating a simple door-related hinge member which will be easy and quick to install without great effort, and in which installation and removal can be accomplished also without a tool.

Setting out from one of the door-related hinge members of the kind described above, this problem is solved by the invention by the fact that each retaining means reaches substantially through the height of the flats on the cup and through an opening in the flange, and is pivoted on the cup at the opening, and that on the emergent upper end of the retaining means an angular lever extending outwardly over the flange engages the handle at its outer free end, and by these means the lever arm can be swung from the first position in which it lies substantially against the flange to a second position lifted away from the flange. With this configuration it is thus possible to avoid a spreading mechanism subject to friction which thus would increase the force necessary for the retention of the cup in the mortise.

The retaining means are best in the form of a component integral with the lever, and at least one radially projecting, sharpened projection can be provided which, in the first position lying on the mounting flange, will lie within the vertical projection of the mortise, while in the second end position raised from the flange it will be in a position in which it will be cutting into the wall of the mortise. The cup will thus be locked in the mortise by the engagement of the sharpened projection in the wall of the mortise, not by the gripping action of an elastic jaw, which in the course of time can be altered by the embrittlement of the material of the jaw, etc.

The handle engaging the outer, free end of the lever arm is, in a preferred embodiment of the invention, pivoted on the lever arm and bears a projecting cam, excentric or the like, which can be thrust against the mounting flange, and which, when in the second position of the lever arm, lies upon the mounting flange and forces the lever arm away from the flange, but in the first extreme position is turned relative to the position thrusting against the mounting flange.

The configuration is preferably made such that the handles have, in plan, the shape of a flat body defined, at least in part, to match the mounting flange, and when in the position against the cam, excentric or the like on the mounting flange, they are lowered to an approximately parallel position resting on the mounting flange. The handle or handles together thus characterize the profile of the mounting flange, so that, when in the lowered position the eye does not perceive them as separate components.

It is advantageous in this case if the bottom of the flat body facing the mounting flange has a recess to accommodate the lever arm; this recess can be formed by a marginal rim projecting at least section-wise toward the flange, substantially along the margin of the flat body.

The flat body of each handle is, in a preferred embodiment of the invention, hinged on an axis at the free end of the particular lever arm, parallel to the plane of symmetry of the cup and parallel to the surface on which the mounting flange rests on the inside of the door.

The cam or cams or excentric or the like are then best formed on the portion of the marginal rim remote from the cup.

In a preferred embodiment of the invention, the retaining means are biased resiliently to the position retracted within the mortise, so that when the lever arms are released by raising the handles they will be resiliently restored to the position permitting removal of the hinge member.

The spring biasing the retaining means can then be in the form of a spring which engages the outer sides of the retaining means, and which is arcuate in the manner of a retaining ring, and it is best made from spring metal and given a curvature where it adjoins the wall of the mortise, the radius of the curvature being selected such that it too will be inside the outline of the mortise when retracted into the latter, but when the retaining means is deployed it will be flexed at least section-wise to such an extent that it will penetrate into the material of the mortise. Thus, another positive anchoring of the cup will be provided by the sections of the spring which penetrate into the material of the mortise, in addition to the anchoring provided by the retaining means.

This additional anchoring can also be improved if teeth are provided on the outer margin of the springs, at least in those areas which penetrate into the material of the wall of the mortise when the retaining means are deployed.

The arrangement of the springs on the retaining means is best such that the free ends of the springs engage a groove near the bottom end of the cup.

The springs are best additionally secured within an opening in the wall of the mortise against shifting at right angles to the bottom of the cup in the area lying between their extremities in contact with the retaining means.

For the installation of the springs it is recommendable to provide an opening accessible on each side of their plane of symmetry by a tool, when they are installed in their position on the cup member of the hinge. It is then possible to introduce the tips of an assembly tool into such openings, which can be in the form of circular punched holes and thereby to flex the springs during assembly to such an extent that their ends can be snapped into the grooves at the bottom end of the retaining jaws.

An additional improvement of the resistance of the door-related hinge part according to the invention to tear-out from the mortise is obtained by adding at least one or more tab-like projections to the two opposite portions of the spring so as to point rearward and radially outward; in a plan view of the springs the free ends of the tab-like projections will have an outline substantially matching the portion of the spring underneath them. These rearwardly slanting tab-like projections, i.e., pointing toward the mouth of the mortise, are spread apart together with the spring, when the retaining means are deployed, so that their free ends will penetrate into the wall of the mortise and thus provide additional retention.

Preferably, the spring with the tab-like projections is a piece stamped integrally from flat sheet metal in a single operation together with tabs pointing radially inward, which are afterward bent back out of the plane of the sheet metal to the outwardly slanting position.

The ends of the tabs can be approximately arcuate in shape, in which case the arc is made substantially equal to the radius of the associated mortise in the door.

Alternatively, sharp-pointed projections can also be provided at the outer end of the tabs.

The invention will be further explained in the following description of an embodiment, in conjunction with the drawing, wherein:

FIG. 3 is a sectional view taken along the plane indicated by the arrows 3—3 in FIG. 2.

FIG. 4 is a side view seen in the direction of arrow 4 in FIG. 2.

FIG. 5 is a sectional view seen in the direction of arrows 5—5 in FIG. 2.

FIG. 6 is a bottom view of the cup member seen in the direction of arrow 6 in FIG. 3.

FIG. 7 is a bottom view of a handle of the cup member according to the invention.

FIG. 8 is a side view of the handle, seen in the direction of arrow 8 in FIG. 7.

FIG. 9 is a side view seen in the direction of arrows 9—9 in FIG. 7.

FIG. 10 is a side view of one of the retaining means of the cup member according to the invention.

FIG. 11 is a side view seen in the direction of arrows 11—11 in FIG. 10.

FIG. 12 is a view seen in the direction of arrow 12 in FIG. 10.

FIG. 13 is a top plan view of a spring provided for biasing the retaining means of the door-related hinge member.

FIG. 16 is a sectional view, corresponding to FIG. 14, through the door in which the cup member is shown in the fastened position.

FIG. 17 is a sectional view through the door in the plane of section indicated by the arrows 17—17 in FIG. 16.

Figure 1:
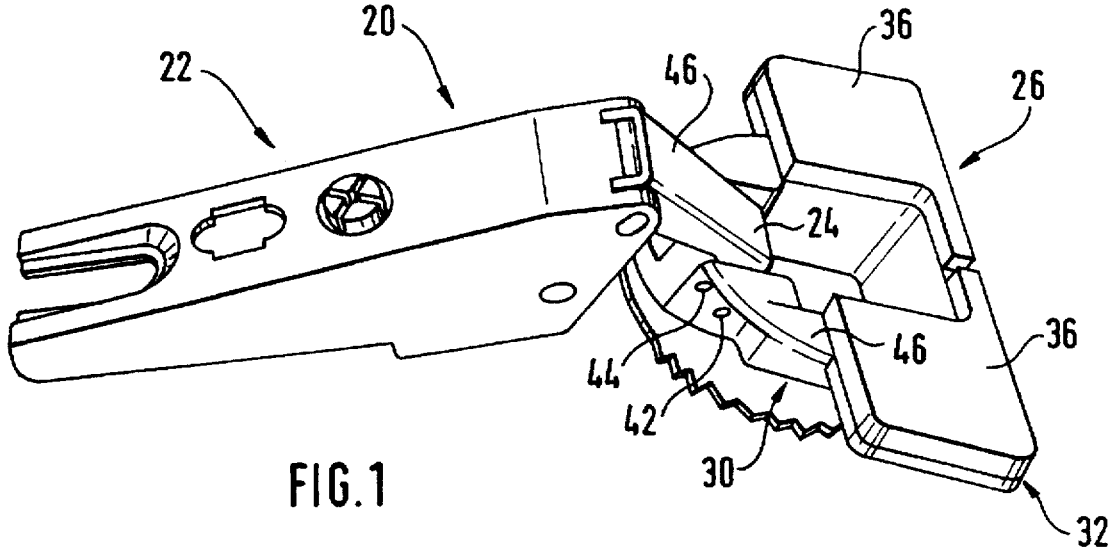
FIG. 1 is a perspective view of a furniture hinge with a door-related hinge member constructed in the manner of the invention.

In FIG. 1 a furniture hinge identified as a whole by the number 20 is represented schematically, in which a carcase-related hinge member in the form of an elongated supporting arm 22 to be fastened adjustably to a side wall of a cabinet is coupled by one of two hinge links, of which only the one hinge link 24 is shown, to a door-related hinge member configured in the manner of the invention as a cup 26 which can be sunk in a mortise in the back of a door (not shown). The hinge cup, or sunken cup, (28) made, in the case illustrated, of sheet metal by stamping and drawing, can be configured in the manner described below in conjunction with FIGS. 2 to 6, and is then held releasably by two retaining means to be described further in connection with FIGS. 10 to 12, on and in the door.

The cup 28 shown in FIGS. 2 to 6 without the said retaining means is composed of the cup part 30 itself, inserted flush within the corresponding mortise 27 in the door 29 (FIGS. 14 to 17) plus a mounting flange 32 disposed on its top margin and projecting laterally on both sides, the underside of which rests on the inside surface of the door 29 when the cup 26 is installed. Centering studs 34 provided at a distance laterally from the cup part 30 itself, and in the illustrated case drawn integrally from the material of the mounting flange and engaging in associated bores in the door, project from the bottom of the mounting flange, and since they serve only for the rotational alignment of the cup member relative to the adjacent edge of the door, i.e., they are not exposed to any stress while the cup is installed, they can have a relatively short length. On the upper side of the mounting flange 32, two actuating means or handles 36 are provided, which are so shaped and defined that, taken together, they just conceal the mounting flange 32. One of these handles 36 is represented separately in FIGS. 7 to 9, and will be described in detail as to their configuration in connection with these figures.

Figure 2:
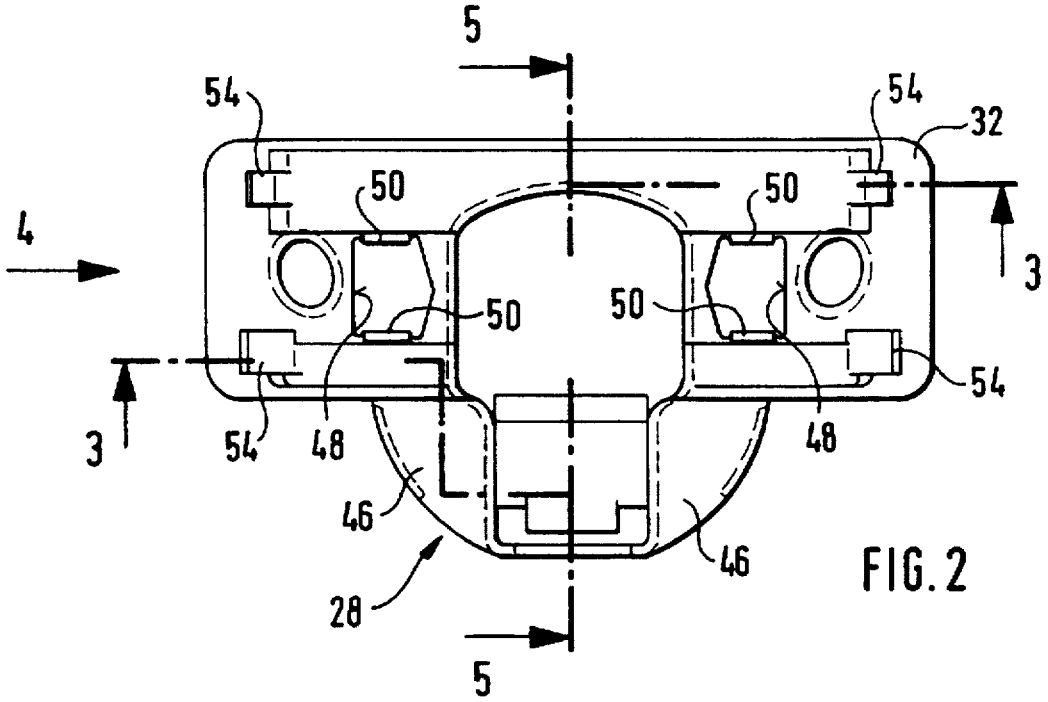
FIG. 2 is a plan view of the cup stamped from sheet metal without the retaining means and handles.
Figure 14:
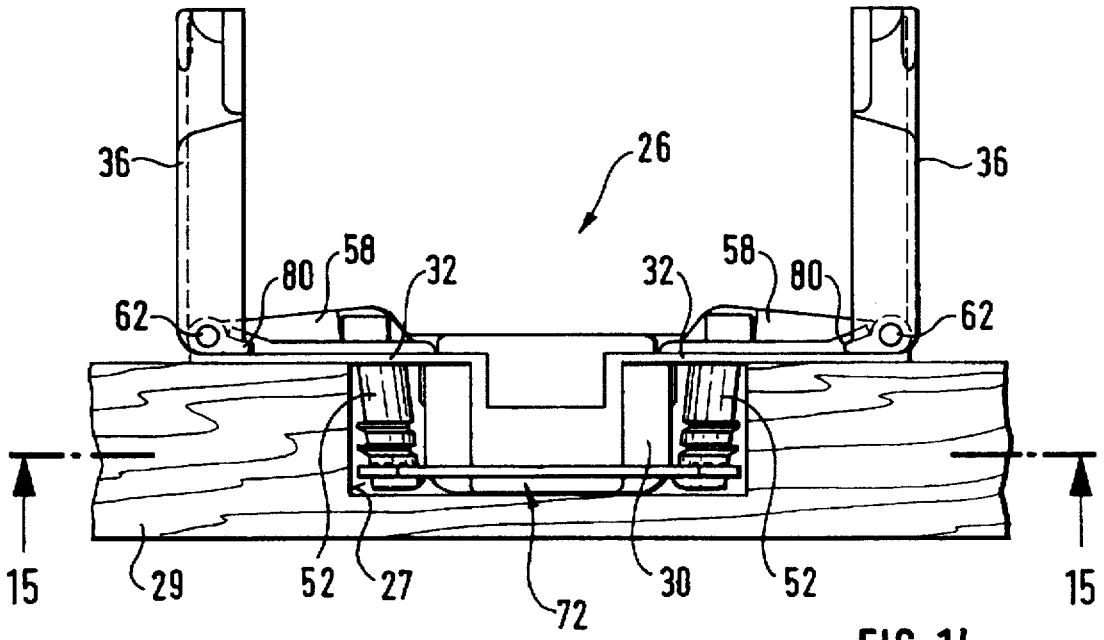
FIG. 14 is a sectional view through a door in the area of the mortise for the cup according to the invention, with the cup—not shown in section—in the position for installation and removal.
Figure 15:
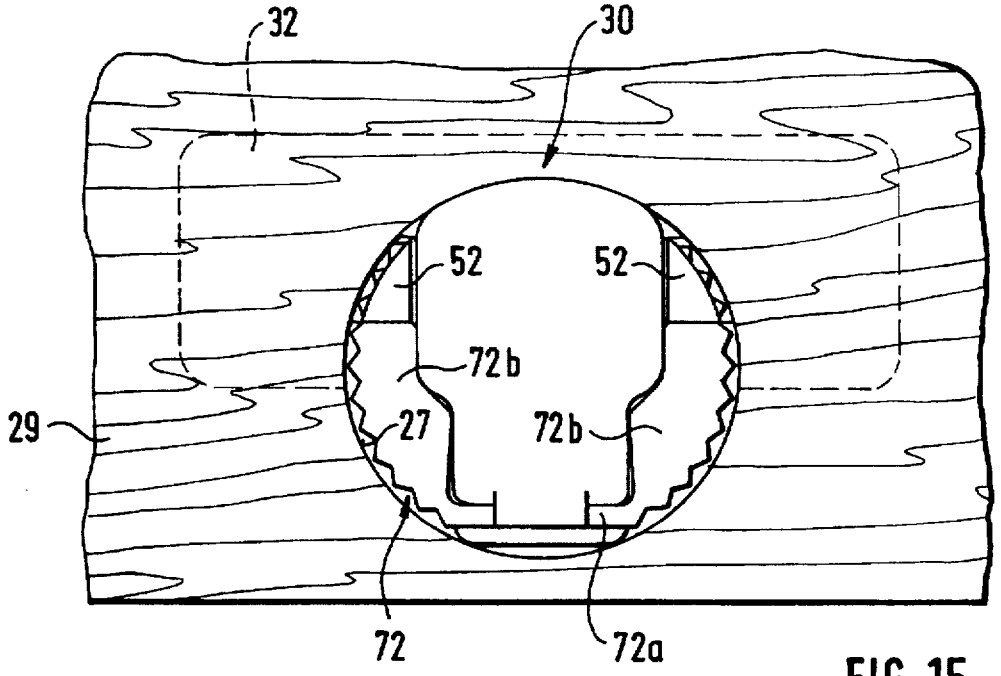
FIG. 15 is a sectional view through the door along the plane of section indicated by the arrows 15—15 in FIG. 14.

The actual cup part 30 of hinge member 28 is in the form of a tub with flat sides having holes 38, 40, punched in its sides, in which are riveted the ends of the pins 42, 44 (FIG. 1) on which the links of the hinge mechanism are journaled. The mounting flange 32 reaches laterally over the generally circular mortise 27 in the door 29, thus covering the space between the cup 30 and the wall of the mortise. However, the space in the front area toward the edge of the door, at the bottom in FIG. 2, is covered by portions 46 of circular shape of the sheet metal material of the hinge member 28, such that the mortise in the door is completely covered when the door-related hinge member 26 is in place.

An opening 48 is punched in the mounting flange 32 on each side between the lateral flats of the cup 30 and the centering pins 34. Two upstanding lugs 50 are formed from the material originally covering the opening 48, and on both sides they guide the retaining means 52 which is passed through the opening 48 and is pivotingly mounted in the opening (FIGS. 10 to 12). In the opposite outer end portions, two ears 54 are cut on three sides from the material of the flange and bent upwardly from the plane of the flange so that their free ends point outwardly away from the cup 30. This creates receivers between the mounting flange 32 and the ears 54, into which cams or the like projecting from the handles 36 to be described in connection with FIGS. 7 to 9 are fitted. The handles are thus secured in this raised position against further turning. The retaining means 52, one of which is shown in FIGS. 10 to 12, are in the form of an elongated body of arcuate shape on its exterior, approximately corresponding to the radius of the mortise, and it is of such dimensions that it can be passed through the opening 48 in mounting flange 32, while its free bottom end will then be approximately at the level of the bottom of the hinge cup 30. Two knife-like projections 56 running circumferentially project at two different levels—in the case represented—from the arcuate exterior of the retaining means, and, when the retaining means 52 rotates radially away from its contact with the lateral flat of the cup, will penetrate into the material of the mortise in the door. At right angles from the upper end of each retaining means 52 a lever 58 extends outwardly over the mounting flange 32, and in its outer, free end there is provided a bore 60 for a pivot pin 62 whose ends protruding from both sides of the lever 58 are held in the handles 36 in sockets 64 (FIGS. 7 and 8). At the upper end of the retaining means 52, in the transition to the integrally joined lever 58, a notch 66 facing the cup is provided, which after introduction of the retaining means into the opening 48 is slipped over the edge facing the cup. The retaining means is then secured in this area against lifting up, but it is nevertheless held for pivoting on the mounting flange 32 in the desired manner. The above-mentioned upstanding lugs 50 hold between them the lateral flats 68 on the lever 58, so that arm 58 and thus the retaining means 52 integral with it is secured against lateral displacement in the opening 48.

Immediately over the bottom end an outwardly open slot 70 is incorporated in each retaining means 52, into which one of the free ends of a spring 72, to be described further on in connection with FIG. 13, can be inserted.

The handles 36, as mentioned before, have a shape in plan which corresponds to half of the mounting flange, so that taken together they cover the mounting flange when in the lowered position (FIG. 16).

The handles 36, formed substantially of a flat body, have along their outer margins a raised rim 74, so that the handles form at their underside facing the mounting flange 32 a recess in which the lever 58 of the associated retaining means 32 can fit. At their outer edges facing away from the cup the raised rims 74 merge with bearing blocks 78, on each of which a cam 80 (FIG. 9) is formed which projects above the edge of the raised rim 74. When in the lowered position the cams 80 force the handles 36 away from the flange 32 by the amount of their length above the raised rim 74, and thus also the free end of the arm 58 joined to them by the pin 62. In this manner the associated retaining means swings radially outward from its contact with the lateral flat on the cup 30, so that the knife-edged projections 56 are forced into the material of the mortise 27 in the door and positively lock the hinge member 26 against extraction from the mortise 29. When the handles 36 are raised up to the position represented in FIG. 14, the cams 80 are turned under the ears 54 and the associated lever 58 is lowered onto the flange, and then also the retaining means is drawn back into contact with the lateral flat on the cup 30. The knife-edged projections 56 are thus retracted into the mortise 27 of the door 29 and the hinge member 26 can then, in this mounting or dismounting position seen in FIG. 14, be extracted from the mortise 27.

In FIG. 13, the flat, retaining-ring-like spring 72 is represented, the outer ends of which engage in the grooves 70 in the retaining means 52 and bias the retaining means to contact with the lateral flats on the cup 30. Therefore the handles 36 also are held resiliently by the levers 58 in the raised mounting or dismounting position. To lock the hinge member in place the handles 36 are then lowered, the cams 80 come in contact with the upper side of the flange 32 and force up the outer end of the handles 36. Then the previously described spreading of the retaining means 52 to the locking position takes place. The position of the cams 80 is so chosen that, when in the intended locking position they are slightly past the dead center position, so that the biasing force of spring 72 in the locking position exert a force, although a slight one, on the handles 36 to keep them down. Due to the configuration and arrangement of the spring 72 and the manner in which the spring force is applied through the cams 80 the handles 36 are thus held on the flange 32 bistably in the end positions. In addition to its purpose of biasing the retaining means 52, the spring 72 is so configured and arranged that it effects a retention of the hinge member 28 in the mortise 27 in addition to the retaining means. At its outer periphery the contour of the spring approximately matches the wall of the mortise 27 in the door 29, and this external contour lies within the projection of the mortise 27 in the mounting and dismounting position. But when the retaining means 52 are deployed the spring 72 is also spread apart, so that then the sections **72*b* joined by a bridge 72*a* penetrate into the wall of the mortise. Sharp-pointed projections 72*c* in the outer contour of the spring 72** facilitate this penetration into the wall of the mortise.

The bridge **72*a* is held in a recess 82 (FIGS. 4 and 5) formed in the cup 30 near its bottom. In the lateral sections 72*b*, a circular hole 84** is provided which serves for holding and flexing the spring by means of an appropriate tool during assembly.

Figure 18:
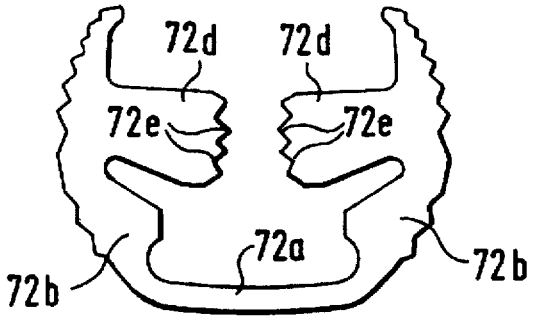
FIG. 18 is a top view of a preliminary stage of a modified spring like the one shown in FIG. 13, biasing the retaining means of the door-related hinge member.
Figure 19:
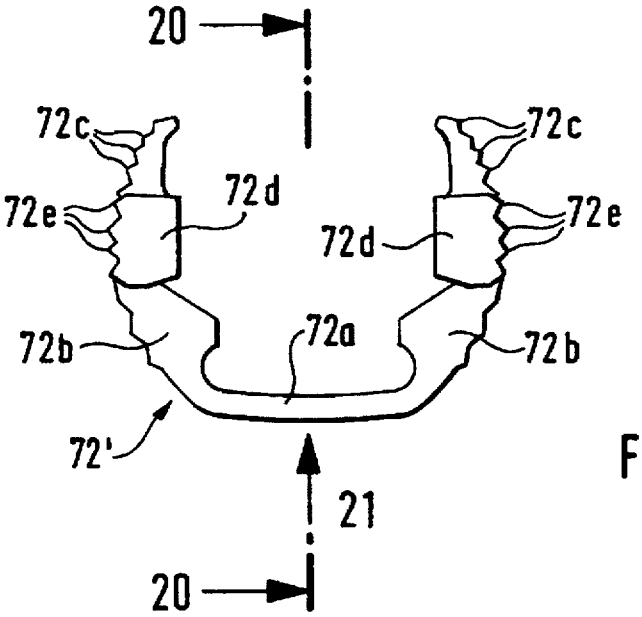
FIG. 19 is a top view of the modified spring in its final form.
Figure 20:
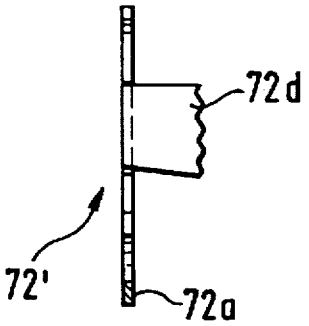
FIG. 20 is a sectional view in the direction of the arrows 20—20 in FIG. 19.
Figure 21:
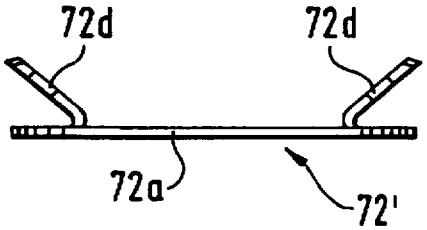
FIG. 21 is a view of the spring seen in the direction of arrow 21 in FIG. 19.

FIGS. 19 to 21 show separately a spring 72' modified with respect to spring 72 described above and shown separately in FIG. 13, while FIG. 18 represents the rough shape of spring 72' after it is stamped out from the flat sheet metal starting material. This spring 72' differs from spring 72 in that tabs **72*d* are integral with the inside margin of sections 72*b* and have the shape seen in FIG. 18. In a following operation the tabs 72*d* are bent upwardly from the plane of the spring to the outwardly slanting position seen in FIGS. 20 and 21**.

After the spring 72' is installed on the cup 30, the tabs **72*d* will thus slant upwardly toward the flange 32. The outer free ends of the tabs 72*d* can either be made arcuate with a radius substantially corresponding to the radius of the mortise 27, or the sharp-pointed projections 72*e* similar to the sharpened projections 72*c* can be provided as shown in FIGS. 18, 19 and 21. The contour of the tabs 72*d* is basically congruous in plan with the corresponding contour of the sections 72*b*, i.e., when the retaining means 52 are in the retracted state, not only sections 72*b* but also the tabs 72*d* are withdrawn within the projection of mortise 27, whereas when the retaining means are deployed the sections 72*b* and, at a different level, the free ends of the tabs 72*d* penetrate into the wall of the mortise 27. In this manner a substantially greater resistance to the tearing out of the hinge member from the mortise 27 is obtained when an additional force in the opening direction is exerted on the hinge arm 22 while it is in the open position. This is to be attributed to the fact that, when such an additional excess force is exerted and a slight displacement toward the mouth of mortise 27 is produced as a result, the slanting tabs 72*d* will flex such that their free ends will increasingly spread apart radially and thus additionally penetrate into the wall of the mortise 27**.

When the additional forces cease, the tabs return to their starting position and the door-related hinge member 26 is resiliently urged back to its proper position installed in the mortise 27.

What is claimed is:

1. A door-related hinge member for a furniture hinge, the hinge member comprising a cup member, the cup member comprising a trough-like cup portion with an integral mounting flange extending laterally from each of two opposite sides of an upper free margin of the cup portion, the cup portion being insertable in a mortise of substantially circular shape in plan in the back face of a door, at least one retaining means comprising an upper portion in the form of an outwardly laterally extending lever arm disposed on an upper face of the mounting flange, and a lower portion extending generally downwardly from the upper portion and reaching through an opening in the mounting flange substantially down to a level of a bottom of the cup portion, and having at least one radially extending projection for engaging a lateral wall of a mortise, the retaining means being mounted on the mounting flange to permit a substantially radial swinging motion with respect to a lateral face of the cup portion, the retaining means being operable by at least one manually operated handle fixed in pivotal relation to an outer free end of the lever arm of the retaining means, the handle comprising means thereon cooperating with the mounting flange for raising or lowering the outer free end of the lever arm in response to handle pivoting, whereby actuation of the at least one handle causes movement of lever arm from a first position lying subtantially against the upper face of the mounting flange through a substantially radial movement of the lever arm to a second, installed position raised slightly from the upper face of the mounting flange, which movement to the second position results in a corresponding movement of the lower portion of the retaining means into contact with a lateral wall of the mortise.

2. Hinge member according to claim 1, wherein each lower portion of the retaining means is an integral component with an associated lever arm.

3. Hinge member according to claim 1 wherein the lower portion of the retaining means comprises said at least one radially extending projection sharpened in the manner of a knife edge, which at least one radially extending projection lies within the space of the mortise when the retaining means is in the first position, while in the second position of the retaining means the lower portion of the retaining means swings radially away from the lateral face of the cup portion and towards and into contact with a lateral wall of the mortise, whereby the at least one radially extending projection cuts retainingly into the wall of the mortise.

4. Hinge member according to claim 1, wherein the handle engaging the lever arm has a substantially eccentric projecting cam which thrusts against the upper face of the mounting flange to thereby force the lever arm away from the upper face of the mounting flange when the handle is in a closed position lying substantially parallel to the upper face of the mounting flange.

5. Hinge member according to claim 4, wherein there are two handles which together have in plan a shape of a flat body defined at least in part to match a plan shape of the mounting flange, to thereby substantially cover the mounting flange when the handles are in the closed position.

6. Hinge member according to claim 5, wherein an underside of each of the handles facing the upper face of the mounting flange has a recess for receiving the associated lever arm.

7. Hinge member according to claim 6, wherein the recess is formed by a downwardly projecting strip running along the margin of each of the handles.

8. Hinge member according to claim 7, wherein each of the handles is articulated at the outer free end of the lever arm about an axis parallel to the plane of symmetry of the cup portion and parallel to a surface of the mounting flange for contacting an inside face of the door.

9. Hinge member according to claim 7, wherein the cam is formed on a portion of the marginal strip facing away from the cup part.

10. Hinge member according to claim 1, wherein the retaining means are resiliently biased away from an adjacent lateral wall of the mortise when in the installed position.

11. Hinge member according to claim 10, wherein a spring biases the retaining means, the spring being formed in the manner of a retaining ring and engaging the outer sides of the retaining means.

12. Hinge member according to claim 11, wherein the spring is made from spring metal, and an outer edge of the spring facing the wall of the mortise when in the installed position is arcuate, the radius of the arc being selected such that, when the retaining means is withdrawn in a first position into the space of the mortise when in the installed position, the spring will also lie within the space of the mortise, but when the retaining means is deployed in the second position in contact with an adjacent lateral wall of the mortise, the spring will be flexed at least section-wise outwardly such that the outer edge of the spring penetrates into the lateral wall of the mortise.

13. Hinge member according to claim 12, wherein sharp-tipped projections are provided at the outer edge of the spring at least in the portions of the spring which penetrate into the lateral wall of the mortise in the installed, second position of the retaining means.

14. Hinge member according to claim 12, wherein free ends of the spring each engage in a groove-like recess adjacent a bottom end of the retaining means remote from the mounting flange.

15. Hinge member according to claim 11, wherein the spring is held securely against displacement by way of a portion of the spring lying between free ends thereof, within a recess formed in an outer lateral wall of the cup portion.

16. Hinge member according to claim 12, wherein the spring has on opposite sides of a plane of symmetry thereof, a through-opening, positioned such that when the spring is installed on the hinge member, the through-opening is accessible for insertion of a positioning tool therein.

17. Hinge member according to claim 12, wherein on each of two opposite sections of the spring, a tab is provided, which when the spring is in the intended mounting position on the cup portion, points radially outward and slantingly backward at a free end thereof, the free end of each of the tabs being defined in a top view of the spring substantially to correspond with a section of the spring directly beneath the tab.

18. Hinge member according to claim 17, wherein the spring with the tabs is a piece stamped from planar sheet metal, in which the tabs, cut integrally in the first stamping with their free ends pointing radially inwardly are bent upwardly out of the plane of the metal to the rearwardly and outwardly pointing position.

19. Hinge member according to claim 17, wherein the outer free ends of the tabs have an approximately arcuate edge, the radius of the arcs being substantially equal to the radius of the lateral wall of the mortise.

20. Hinge member according to claim 17, wherein sharp-pointed projections are provided at an outer edge of the free ends of the tabs.

21. Hinge member of claim 1, further comprising on an underside of the mounting flange at least one centering pin projecting substantially at right angles for engagement in an installed position in a bore in the door adjacent the mortise.

* * * * *